US006210223B1

(12) United States Patent
Aoyama et al.

(10) Patent No.: US 6,210,223 B1
(45) Date of Patent: Apr. 3, 2001

(54) SHIELDED CONNECTOR, A SET OF SHIELDED CONNECTORS AND METHOD FOR CONNECTING A SHIELDED CONNECTOR WITH A SHIELDED CABLE

(75) Inventors: Masahiko Aoyama; Masashi Saito; Takashi Koide, all of Yokkaichi; Masahiro Tanaka, Aichi-ken, all of (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/444,279

(22) Filed: Nov. 19, 1999

(30) Foreign Application Priority Data

Nov. 19, 1998 (JP) ..... 10-329685
Dec. 1, 1998 (JP) ..... 10-341993
Dec. 2, 1998 (JP) ..... 10-342535

(51) Int. Cl.[7] ..... H01R 9/05
(52) U.S. Cl. ..... 439/585; 439/877; 439/610
(58) Field of Search ..... 439/585, 877, 439/610

(56) References Cited

U.S. PATENT DOCUMENTS 2,789,279 4/1957 Gebel .
4,744,769 5/1988 Grabbe et al. .
5,145,409 9/1992 Sato et al. .
5,169,340 12/1992 Nakata et al. .
5,484,961 * 1/1996 Itoh et al. ..... 439/877
5,542,861 * 8/1996 Anhalt et al. ..... 439/585
5,667,404 9/1997 Kato et al. .
5,975,950 11/1999 Yamaguchi ..... 439/585
6,089,616 * 5/2000 Bluemmel et al. ..... 439/877

FOREIGN PATENT DOCUMENTS

0510264 * 10/1992 (EP) .
4-52372 5/1992 (JP) .
5-27983 4/1993 (JP) .

* cited by examiner

*Primary Examiner*—Brian Sircus
*Assistant Examiner*—Hae Moon Hyeon
(74) *Attorney, Agent, or Firm*—Anthony J. Casella; Gerald E. Hespos; Michael J. Porco

(57) ABSTRACT

A shielded connector is provided with an improved shielding characteristic. The shielded connector includes male and female shielded connectors (10*a*, 10*b*). A section of an inner conductor (51) of a shielded cable (50) that is not covered by an outer conductor (52) and a portion of an inner terminal (20*a*) at and near an inner crimping portion (24) that is fastened to the leading end of the inner conductor (51) are covered on three sides by a covering portion (45). Accordingly, shielding characteristic can be improved remarkably. By connecting the male and female shielded connectors (10*a*, 10*b*) with opening surfaces of the covering portions (45) thereof faced in opposite directions, radiation characteristic can be balanced. Therefore, an influence on a high-frequency signal transmitting through the inner conductor (51) can be reduced when it is passing through the shielded connectors (10*a*, 10*b*), with the result that shielding characteristic can be improved.

5 Claims, 5 Drawing Sheets

SHIELDED CONNECTOR, A SET OF SHIELDED CONNECTORS AND METHOD FOR CONNECTING A SHIELDED CONNECTOR WITH A SHIELDED CABLE

BACKGROUND OF THE INVENTION

1. Field of the Invention

The present invention relates to a shielded connector, a set of shielded connectors and a method for connecting a shielded connector with a shielded cable.

2. Description of the Related Art

A known shielded connector is disclosed in Japanese Unexamined Utility Model Publication No. 5-27983, and is illustrated in FIGS. 6–8. This prior art terminal 1 is provided with an inner terminal 2 and an outer terminal 3. Three crimping portions also are provided, namely, an inner conductor crimping portion 2*a* on the inner terminal 2, an outer conductor crimping portion 3*b* on the outer terminal 3 and a sheath crimping portion 3*c* also on the outer terminal 3.

A prior art shielded cable 2 is processed for connection to the prior art shielded connector 1. As part of this processing, an inner conductor 51 of the shielded cable 50 is exposed by stripping a sheath 54, an outer conductor 52 and an insulating element 53 at an end of the shielded cable 50. The inner conductor crimping portion 2*a* of the prior art inner terminal 2 will be fastened to this exposed end of inner conductor 51. An additional portion of the sheath 54 is stripped at this end of the shielded cable 50 to expose the outer conductor 52. The outer conductor crimping portion 3*b* of the prior art terminal 3 will be fastened to the exposed portion 56 of the outer conductor 52, and the sheath crimping portion 3*c* of the prior art terminal 3 will be fastened to the sheath 54 at the end of the shielded cable 50 located behind the exposed portion 56.

The three crimping portions are crimped simultaneously after the aforementioned shielded connector 1 is placed in a crimper. Since the inner terminal 2 is crimped after being accommodated in the outer terminal 3, it is essential for the outer terminal 3 to be formed with openings 3*a* in its top and bottom walls in order for crimping molds of the crimper to reach the inner terminal 2 accommodated in the outer terminal 3. However, because of the presence of the openings 3*a*, a portion of the inner conductor 51 not covered by the outer conductor 52 and the inner terminal 2 are exposed to the outside through the openings 3*a*. This exposure reduces shielding. Thus, depending on the situation, it is necessary to apply additional shielding using another member.

The present invention was developed in view of the above problem and an object thereof is to provide a shielded connector, a set of shielded connectors and a method for connecting a shielded connector with a shielded cable allowing for an improved shielding characteristic.

SUMMARY OF THE INVENTION

According to the invention, there is provided a shielded connector that is connectable with a shielded cable. The shielded cable has an insulating element provided between inner and outer conductors. The outer surface of the outer conductor of the shielded cable is covered by a sheath. The shielded connector comprises an inner terminal that is connectable with the inner conductor. The connector also comprises an outer terminal which is adapted to at least partly accommodate the inner terminal with a dielectric element provided therebetween. The outer connector is connectable with the outer conductor of the shielded cable. The inner terminal is or can be fastened to the inner conductor of the shielded cable at a location that is at least partly outside the outer terminal. A covering portion extends from the outer connector and surrounds at least three sides of that portion of the inner terminal to be fastened to the inner conductor.

According to a preferred embodiment, the outer terminal is formed to be fastened to the outer conductor of the shielded cable while the inner terminal is connected with the inner conductor.

According to a further preferred embodiment, a shielded connector is connectable with a shielded cable. The cable includes an insulating element between inner and outer conductors, and the outer surface of the outer conductor is covered by a sheath. The shielded connector comprises an inner terminal connectable with the inner conductor. An outer terminal is adapted to accommodate the inner terminal with a dielectric element provided therebetween. The outer terminal also is connectable with the outer conductor. The inner terminal is fastened to the inner conductor of the shielded cable outside the outer terminal. The outer terminal is formed to be fastened to the outer conductor of the shielded cable with the inner terminal connected with the inner conductor. A portion of the inner terminal that is to be fastened to the inner conductor is surrounded at least on three sides by wall surfaces.

Accordingly, the outer terminal needs not be formed with openings for the insertion of crimping molds and are therefore allowed to have closed surfaces since the inner terminal is fastened outside the outer terminal. Thus, the inner conductor not covered by the outer conductor and a portion of the inner conductor fastened to the inner conductor can be covered at least on three sides by the wall surfaces of the outer terminal. As a result, shielding performance can be improved.

Preferably, the outer conductor is at least partly folded back over the sheath thereby forming a folded portion, and the outer terminal is formed with a crimping portion which can be fastened at least partly to the folded portion or both to the folded portion of the outer conductor and to the sheath. Thus the outer terminal can be fastened to the outer conductor and the sheath by one crimping operation. Accordingly, the crimping molds for crimping the outer terminal can be constructed to crimp one crimping portion, and do not need to be constructed in conformity with a plurality of crimping portions along the length of the outer terminal. Therefore, the crimping molds are allowed to have a simple construction and portions of the crimping molds that correspond to the crimping portion can be made shorter.

Most preferably, a portion of the inner terminal to be fastened to the inner conductor is surrounded on three sides by the wall surfaces. Thus, the outer terminal leaves only one surface open. A mating connector is constructed similarly. Additionally the two mateable connectors are oriented during mating such that open surfaces of the respective outer terminals face in opposite directions. Accordingly, the radiation characteristic can be balanced by connecting the male and female shielding connectors with the open surfaces thereof faced in opposite directions. The radiation characteristic is influential on the high-frequency signal transmitted. As a result the shielding characteristic can be improved by the balancing of the radiation characteristic.

According to the invention, there is further provided a set of shielded connectors. A first shielded connector in the set has a portion of the inner terminal to be fastened to the inner conductor substantially surrounded on three sides by the covering portion. Thus only one surface is left substantially open. A second mating connector in the set is constructed similarly, but is connectable to the first shielded connector such that the substantially open surface of its outer terminal faces in a different direction, and preferably a substantially opposite direction.

The invention also is directed to a method for connecting or crimping a shielded connector, with a shielded cable. The shielded cable has an insulating element provided between inner and outer conductors, and the outer surface of the outer conductor is covered by a sheath. The method comprises fastening an inner terminal of the shielded connector to the inner conductor of the shielded cable at least partly outside an outer terminal of the shielded connector. The method then comprises substantially covering with a covering portion of the outer terminal at least three sides of the section of the inner terminal to be fastened to the inner conductor.

According to a preferred embodiment of the invention, the method further comprises fastening the outer terminal to the outer conductor of the shielded cable after the inner terminal is connected with the inner conductor in the inner terminal fastening step.

Preferably, the method further comprises stripping the sheath to substantially expose the outer conductor, folding the exposed portion of the outer conductor back over the sheath and fastening a crimping portion of the outer terminal to both the sheath and the outer conductor.

Most preferably, in the fastening step crimping pieces of the crimping portion are crimped to at least partly wind on or around the outer conductor with the end of a first crimping piece substantially placed or placeable on that of a second crimping piece.

These and other objects, features and advantages of the present invention will become more apparent upon a reading of the following detailed description and accompanying drawings.

DETAILED DESCRIPTION OF THE PREFERRED EMBODIMENT

Figure 1:
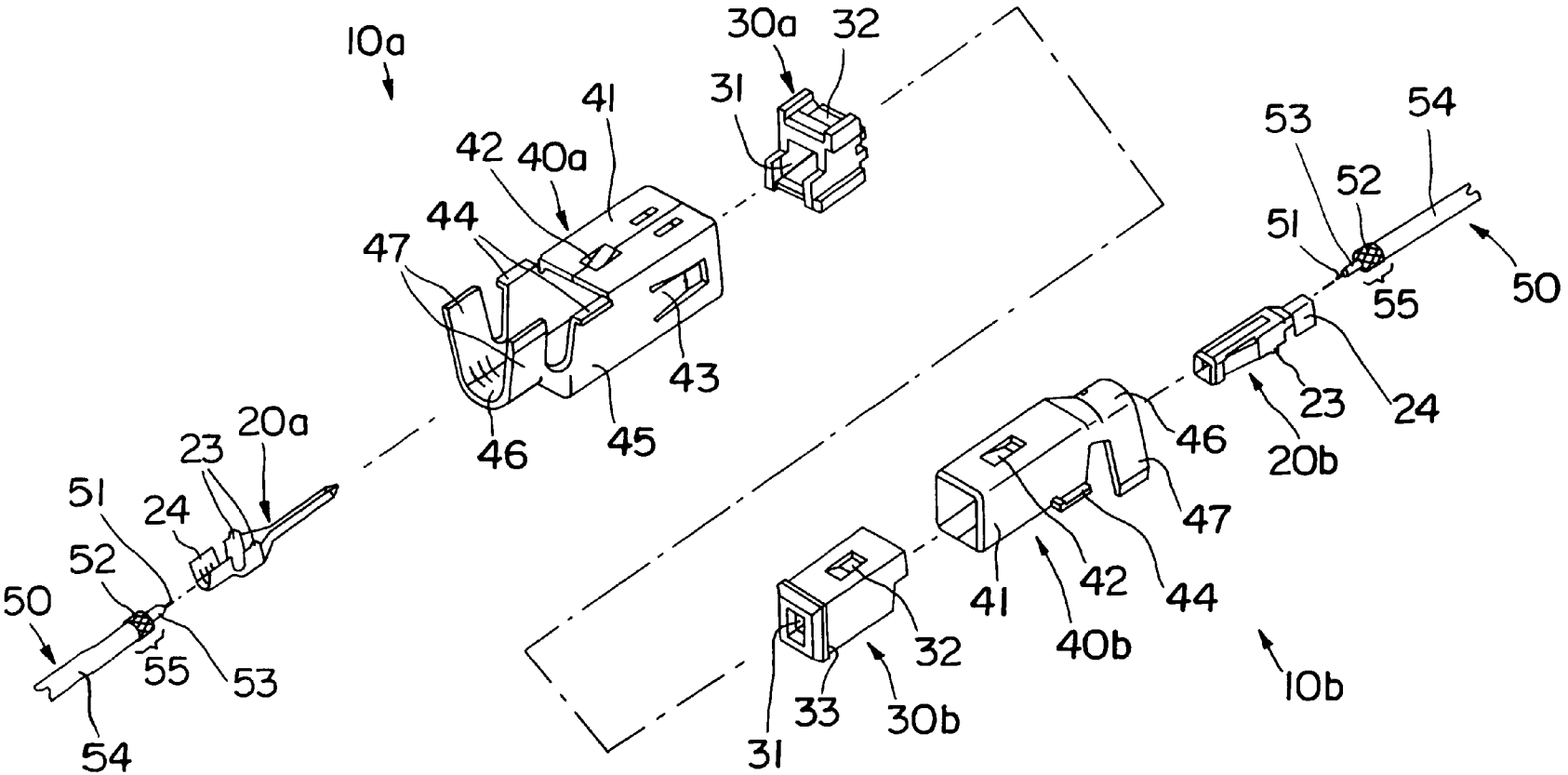
FIG. 1 is an exploded perspective view showing parts constructing a shielded connector according to one embodiment of the invention.

Shielded connectors 1O*a*, 1O*b* according to this embodiment are connectable with each other and have such an integral construction that inner terminals 20*a*, 20*b* are accommodated in outer terminals 40*a*, 40*b* with dielectric elements 30*a*, 30*b* provided therebetween. Shielded cables 50 are connectable with the shielded connectors 10*a*, 10*b* (see FIG. 1).

The female shielded connector 10*b* differs from the male shielded connector 10*a* in several respects. First, the inner terminal 20*b* is a female terminal on the female shielded connector 10*b*, whereas the inner terminal 20*a* on the male shielded connector 10*a* is a male terminal. Second, the outer terminal 40*b* of the female shielded connector 10*b* is dimensioned to be accommodated in the outer terminal 40*a* of the male shielded connector 10*a*. Third, the outer terminal 40*a* of the male shielded connector 10*a* is provided with contact pieces 43, and a touching or contact piece 48, whereas the outer terminal 40*b* of the female shielded connector 10*b* has no contact pieces comparable to the elements 43 and 48. However, since the female and male shielded connectors 10*a*, 10*b* are constructed and assembled similarly in other respects, only the male shielded connector 10*a* is described here to avoid repetitive description and the same or similar construction is identified by the same or similar reference numerals.

A side (right side in FIG. 2) of the inner terminal 20*a* of the connector 10*a* to be connected with an unillustrated mating inner terminal is referred to as a front side and an opening direction (an upward direction in FIG. 2) of a covering portion 45 is referred to as an upward direction.

The shielded cable 50 has a substantially coaxial construction with an insulating element 53 provided between an inner conductor 51 and an outer conductor 52. The inner conductor 51 is formed, e.g., by bundling a plurality of strands and the outer conductor 52 is made, e.g., of a braided wire or a metal sheet. The outer surface of the outer conductor 52 is covered by a sheath 54 made, for example, of vinyl. The sheath 54 is stripped at one end of the shielded cable 50 to partly expose the outer conductor 52. The exposed portion of the outer conductor-then is folded back at least partly over the sheath 54, to form a folded portion 55. The insulating element 53 is stripped forwardly of the folded portion 55 to expose part of the inner conductor 51 (see FIG. 1). The exposed leading end of the inner conductor 51 is or can be connected with the inner terminal 20*a*, and the outer conductor 52 is or can be connected with the outer terminal 40*a* via the folded portion 55.

The inner terminal 20*a* of the male shielded connector 10*a* is an electrically conductive male terminal, as shown in FIG. 1, and a front part of the inner terminal 20*a* is formed into a tab that is connectable with the inner terminal 20*b* of the female shielded connector 10*b*. The middle of the inner terminal 20*a* is provided with a pair of biting projections 23 for biting into or engaging the inner wall of an accommodating hole 31 of the dielectric element 30*a* when the inner terminal 20*a* is inserted into the dielectric element 30*a*, as described later. An inner crimping portion 24 is provided behind the biting projections 23 and preferably is comprised of at least one pair of crimping pieces for fastening to the inner conductor 51.

The dielectric element 30*a* is made of an insulating material, such as resin, and electrically insulates the inner and outer terminals 20*a*, 40*a* from each other. The accommodating hole 31 is formed inside the dielectric element 30*a* to accommodate and fix the inner terminal 20*a*. Further, a locking recess 32 is formed in the outer surface of the top of the dielectric element 30*a* and a contact portion 33 is provided on the outer surface of the bottom of the dielectric element 30*a* to fix the dielectric element 30*a* in the outer terminal 40*a* (see FIGS. 1 and 2).

The outer terminal 40*a* is formed by bending an electrically conductive plate, and a front part thereof is an accommodating portion 41 that preferably is in the form of a substantially rectangular tube. An elastically deformable locking portion 42 is formed in the top wall of the outer terminal 40*a*, and projects inwardly and obliquely backward to lock the aforementioned dielectric element 30*a* in a specified position in the accommodating portion 41. A contact piece 48 is cut in the bottom wall of the outer terminal 40*a* and is bent inwardly at an angle different from 0° or 180°, and preferably substantially at right angles. Further, contact pieces 43 are formed in the right and left walls of the outer terminal 40*a* to project inwardly and obliquely forwardly for elastically contacting the female shielded connector 10*b*.

The covering portion 45 is provided behind the accommodating portion 41 and is constructed to be substantially closed on three sides by the left, right and bottom walls. The covering portion 45 improves a shielding characteristic for the inner conductor 51 and the inner crimping portion 24 of the inner terminal 20*a* which are to be accommodated therein. This improvement in the shielding characteristic is described later. Stabilizers 44 are provided at the upper ends of the covering portion 45 and project outwardly along the transverse direction of the outer terminal 40*a* (see FIG. 1). The stabilizers 44 are configured to prevent an upside-down insertion of the shielded connector 10*a* into an unillustrated connector housing, to introduce the outer terminal 40*a* in a correct direction and to fix the shielded connector 10*a* stably in the connector housing. The stabilizers 44 also function to lock an unillustrated retainer for securely locking the inserted shielded connector 10*a* in the connector housing.

An outer crimping portion 46 is provided behind the covering portion 45 for fastening to the outer conductor 52, preferably to the folded portion 55 of the shielded cable 50. At least one pair of strip-shaped crimping pieces 47 extend from the bottom of the outer crimping portion 46. The crimping pieces 47 are spaced apart wider from each other toward their leading ends, and preferably have such a length that they can surround shielded cables of various diameters.

The shielded connector 10*a* is assembled as follows. First, the inner crimping portion 24 of the inner terminal 20*a* is fastened to the partly exposed inner conductor 51 before the inner terminal 20*a* is inserted into the outer terminal 40*a*.

Next, the dielectric element 30*a* is inserted at least partly into the accommodating portion 41 of the outer terminal 40*a* from front. After sufficient insertion, the touching piece 48 comes substantially into contact with the contact portion 33 and the locking portion 42 slips into or is positioned in the locking recess 32. Thus the dielectric element 30*a* is locked substantially in the specified position in the accommodating portion 41. The inner terminal 20*a* that has been connected with the inner conductor 51 is inserted at least partly into the accommodating hole 31 of the dielectric element 30*a*. The biting projections 23 of the inner terminal 20*a* bite into or engage the wall of the accommodating hole 31 during this insertion to fix the inner terminal 20*a* stably in the dielectric element 30*a*, as shown in FIG. 2.

The folded portion 55 of the cable 50 then is placed on the bottom of the crimping portion 46 of the outer terminal 40*a*, and the shielded connector 10*a* is placed in an unillustrated crimper. The folded portion 55 is placed on the bottom of the outer crimping portion 46 of the outer terminal 40*a*. The crimping portion 46 of the outer terminal 40*a* is held tightly between unillustrated crimping molds and the crimping pieces 47 are crimped or folded into close contact with the outer surface of at least part of the folded portion 55 of the shielded cable 50. The crimping preferably is carried out such that the end of one crimping piece 47 is placed on that of the other crimping piece 47. In this way, the male shielded connector 10*a* is assembled.

Figure 2:
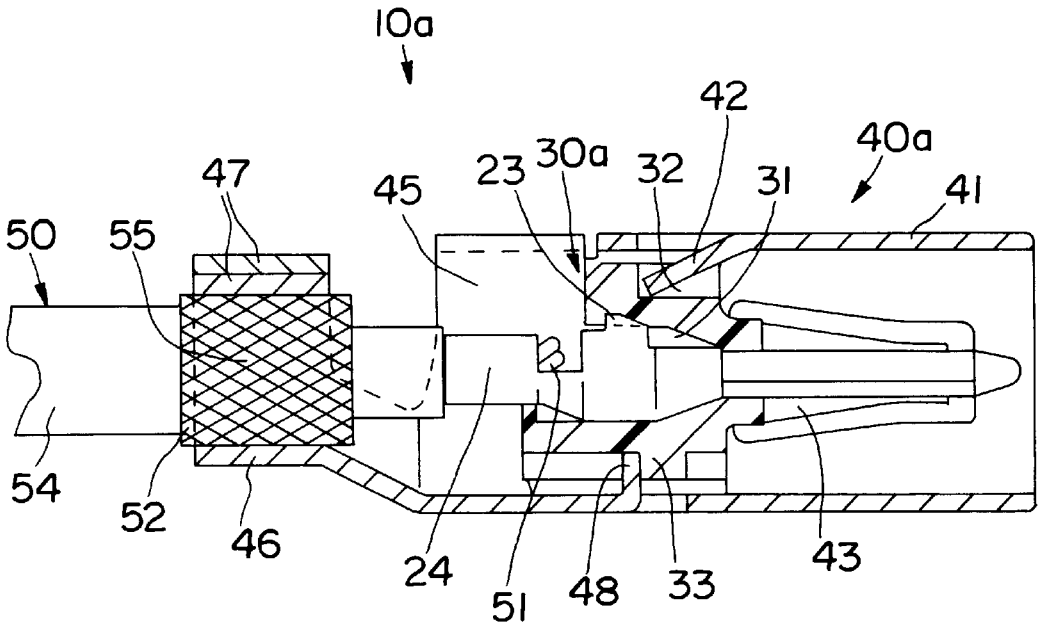
FIG. 2 is a section of an assembled male shielded connector.

When the shielded connector 10*a* is assembled as shown in FIG. 2,the covering portion 45 covers or surrounds portions of the inner conductor 51 that are not covered by the outer conductor 52 and sections of the inner crimping portion 24 of the inner terminal 20*a* that are fastened to the leading end of the inner conductor 51.

Since the inner conductor 51 behind the folded portion 55 is covered by the outer conductor 52 and since a front part of the inner terminal 20*a* accommodated in the accommodating portion 41 is surrounded by the walls of the accommodating portion 41, they are both surrounded on their four sides by the conductive elements. Thus, there is no problem in shielding at those locations. It is most desirable in terms of shielding characteristic to similarly cover or enclose, on four sides, those portions the inner conductor 51 that are not covered by the outer conductor 52 and portions of the inner crimping portion 24 that are not covered on four sides by the accommodating portion 41.

However, in this embodiment, only the upper surface of the covering portion 45 is open and the remaining three surfaces are closed since the shielded connectors 10*a*, 10*b* are locked by locking portions when accommodated in the unillustrated connector housing. Only a slight clearance is formed between the covering portion 45 and the outer crimping portion 46 in order to easily form the outer crimping portion 46. However it is desirable to substantially close this clearance. In this embodiment, the clearance is made as narrow as possible while realizing the above purpose.

Figure 3:
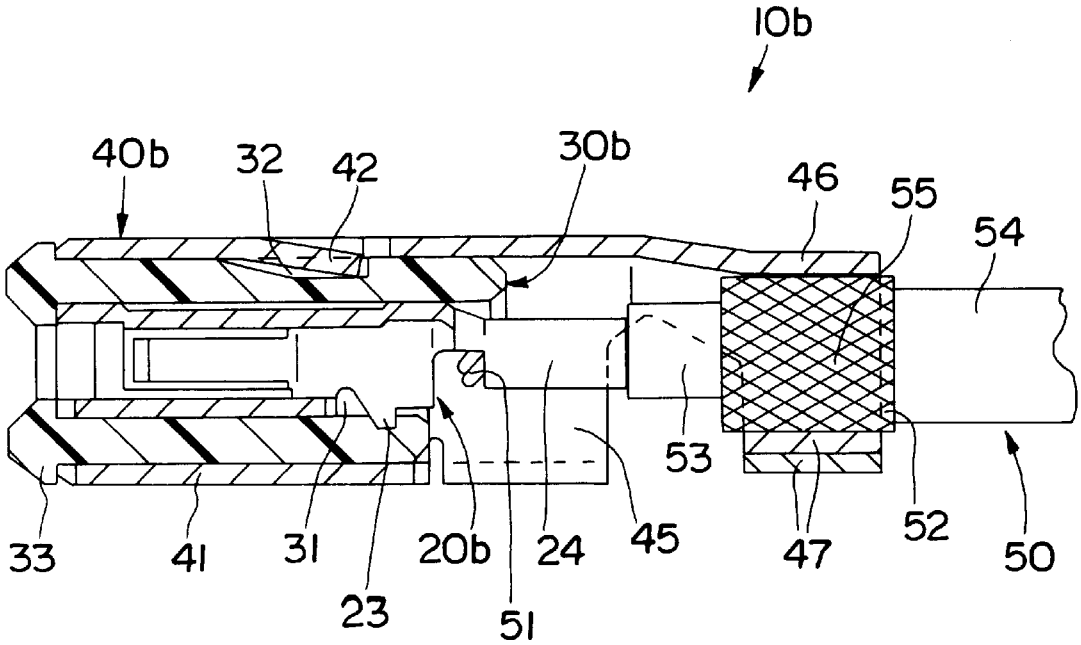
FIG. 3 is a section of an assembled female shielded connector.

According to the shielded connectors 10*a*, 10*b* of this embodiment, the portion of the inner conductor 51 not covered by the outer conductor 52 and the portion of the inner terminal 20*a* at and near the inner crimping portion 24 are covered substantially by the left, right and bottom walls of the shielded connector 10*a* or the left, right and top walls, in the case of the shielded connector 10*b* (see FIGS. 2 and 3). Thus, the shielding characteristic can be improved remarkably with respect to leftward, rightward and downward (upward in the case of the shielded connector 10*b*) directions. Further, the shielding characteristic can be improved further by making the clearance between the covering portion 45 and the outer crimping portion 46 as narrow as possible.

In the shielded connectors 10*a*, 10*b* according to this embodiment, the inner terminals 20*a*, 20*b* and the respective inner conductors 51 are accommodated at least partly in the outer terminals 40*a*, 40*b*, which then are fastened to the folded portions 55. Accordingly, the outer terminals 40*a*, 40*b* can be fastened by applying crimping in only one position. Thus, the crimping molds used to crimp the outer terminals 40*a*, 40*b* can be constructed to crimp only the outer crimping portion 46, and the crimping molds need not be constructed in conformity with a plurality of crimping portions. Thus, the crimping molds are allowed to have a simple construction and the entire length of the portion of each mold corresponding to the outer crimping portion 46 can be made shorter. Further, since the outer terminals 40*a*, 40*b* are crimped only once, efficiency in crimping operation can be improved since the adjustment of a crimping force and confirmation as to whether or not fastening has been satisfactorily performed are made only for the single crimping portion 46.

Figure 4:
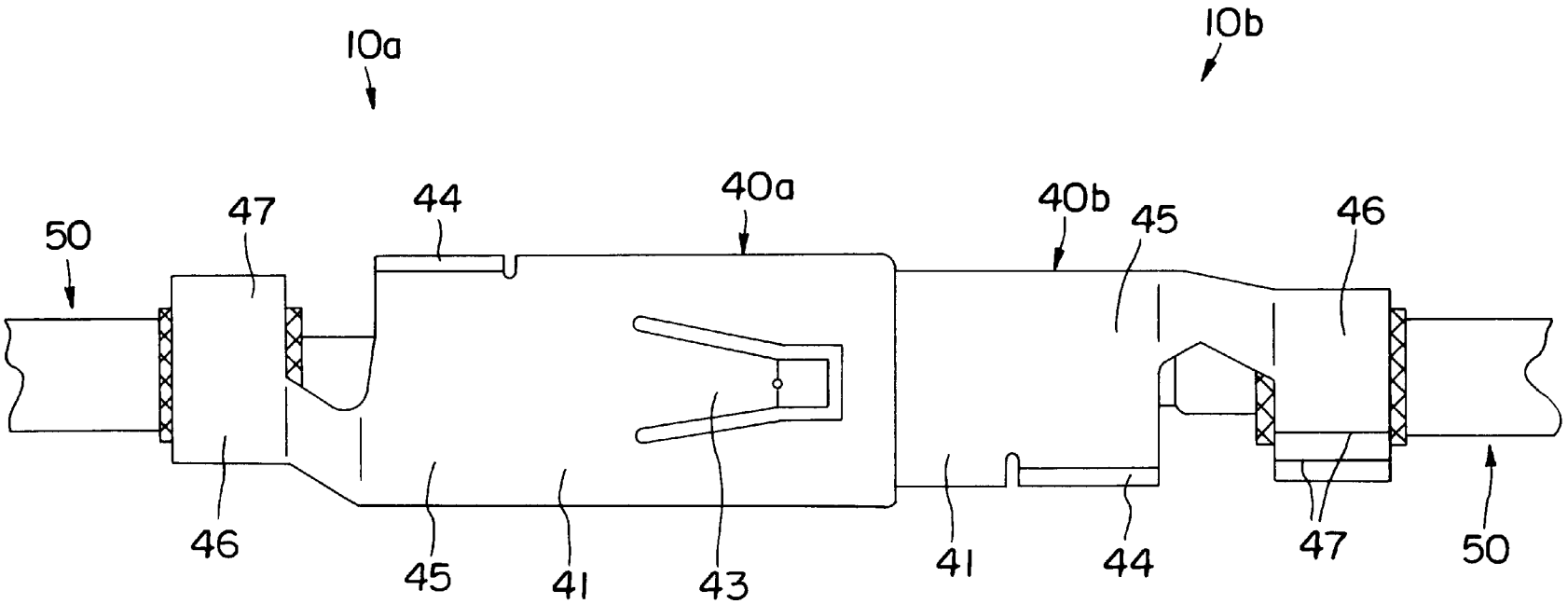
FIG. 4 is a side view of the shielded connectors after connection.
Figure 5:
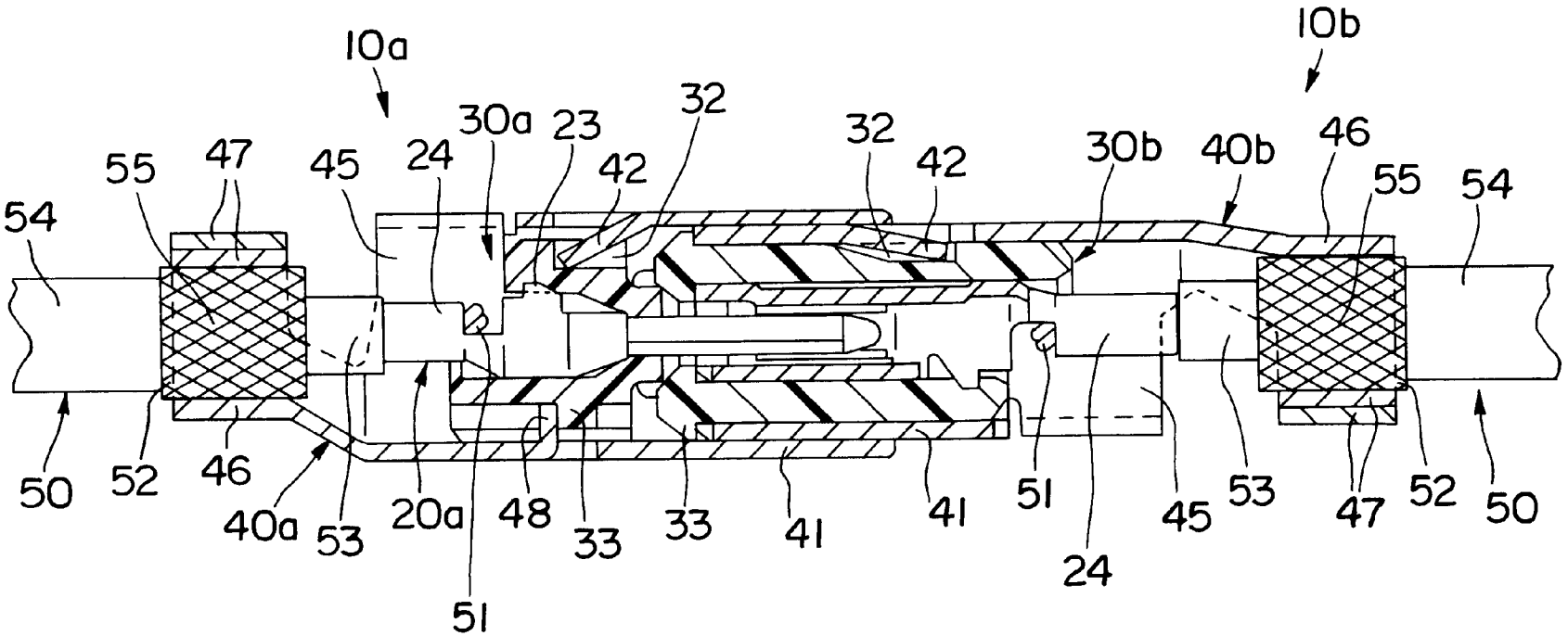
FIG. 5 is a section of the connected shielded connectors.
Figure 6:
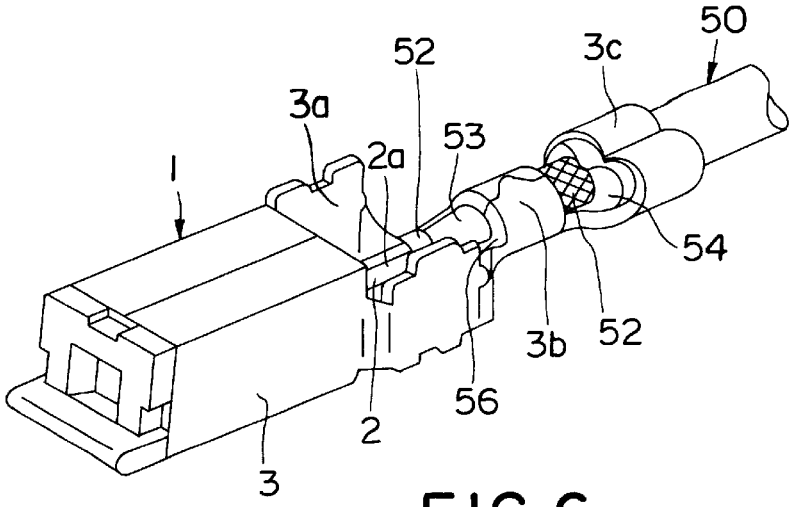
FIG. 6 PRIOR ART
FIG. 6 is a perspective view of a prior art shielded connector.
Figure 7:
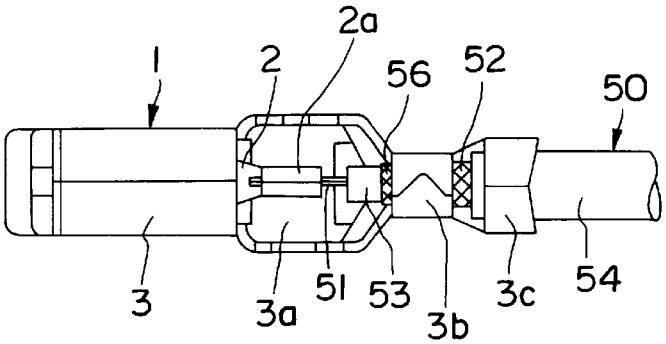
FIG. 7 PRIOR ART
FIG. 7 is a plan view of the prior art shielded connector.
Figure 8:
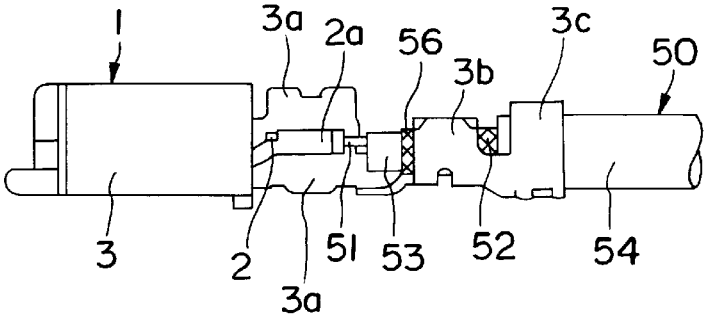
FIG. 8 PRIOR ART
FIG. 8 is a side view partly in section of the prior art shielded connector.

FIGS. 4 and 5 show a state where the male and female shielded connectors 10*a*, 10*b* are connected with each other.

In FIGS. 4 and 5, the shielded connectors 10*a*, 10*b* are connected with the open surfaces of their covering portions 45 facing in different directions.

In the case that the covering portions 45 of the shielded connectors 10*a*, 10*b* have an open surface, the intensity of a high frequency signal may change slightly due to its radiation to the outside via the open surface and/or noise may enter from the outside. In such a case, if the open surfaces of the male and female connectors 10*a*, 10*b* are facing in the same direction, the signal radiates in the same direction and noise enters from the same side. This causes a variation in the high-frequency signal, which then causes a variation in the performance characteristic of the side surfaces of the connector, thereby causing a problem.

By connecting the male and female shielded connectors 10*a*, 10*b* with their open surfaces faced in different directions, the radiation of the high-frequency signal and the intrusion of noise can be balanced symmetrically. Therefore, a performance reduction in a specific direction can be prevented when the high-frequency signal transmitting through the inner conductor 51 passes the shielded connectors 10*a*, 10*b*, with the result that the shielding characteristic can be improved.

The present invention is not limited to the foregoing embodiments. For example, embodiments as described below are also embraced by the technical scope of the present invention as defined in the claims. Besides the following embodiments, a variety of changes can be made without departing from the scope and spirit of the present invention as defined in the claims.

Although the covering portion 45 has an open surface in the foregoing embodiment, it may be closed on its four sides by wall surfaces without having any open surface. With such a construction, shielding performance can be further improved.

Although the female and male shielded connectors are connected with each other in the foregoing embodiment, the invention is also applicable to a shielded connector directly connectable with a circuit board of an electric equipment or the like.

The covering portion 45 may be provided as a separate or as an integral or unitary part of the outer terminal 40.

What is claimed is:

1. A set of shielded connectors, comprising first and second shielded connectors, each said shielded connector being connectable to a shielded cable, each said shielded cable having an inner conductor, an insulating element surrounding the inner conductor, an outer conductor surrounding the insulating element and a sheath surrounding the outer conductor, portions of the sheath and the insulating element being removed to expose the inner and outer conductors, each said shielded connector comprising an inner terminal configured for connection with the inner conductor and an outer terminal configured for connection with the outer conductor, the outer terminal further being configured to accommodate at least part of the inner terminal, with a dielectric element provided between portions of the inner and outer terminals, wherein in each of said shielded connectors, the portion of the outer terminal that is fastenable to the outer conductor is surrounded substantially on three sides by the covering portion, leaving one surface substantially open, and the second shielded connector being mateable with the first shielded connector such that the substantially open surface of the outer terminal of the second shielded connector faces in a substantially opposite direction from the open surface of the outer terminal of the first shielded connector.

2. A shielded connector according to claim 1, wherein the outer terminal is formed such that it can be fastened to the outer conductor of the shielded cable while the inner terminal is connected with the inner conductor.

3. A shielded connector according to claim 1, wherein the outer conductor is at least partly folded back over the sheath thereby forming a folded portion, and the outer terminal is formed with a crimping portion which can be fastened to at least part of the folded portion.

4. A shielded connector and cable assembly comprising:

first and second shielded cables, each said cable having an inner conductor, an insulating element surrounding the inner conductor, an outer conductor surrounding the insulating element and a sheath surrounding the outer conductor, the cable having an end and having portions of the insulating element, the outer conductor, and the sheath removed adjacent the end to expose the inner conductor, additional portions of the sheath being removed in proximity to the exposed portion of the inner conductor for exposing the outer conductor;

first and second shielded connectors, each said shielded connector comprising:

an inner terminal connected to the exposed portion of the inner conductor;

a dielectric element surrounding at least portions of the inner terminal; and an outer terminal having an accommodating section surrounding and engaging the dielectric element, a crimping portion spaced from the accommodating section and crimped into secure crimped engagement with at least portions of the outer conductor and a covering portion extending between the accommodating section and the crimping portion, the covering portion being substantially aligned with and spaced from the connection of the inner terminal to the inner conductor, the covering portion being configured to surround at least three sides of the connection of the inner terminal with the inner conductor for limiting a radiation characteristic of the assembly while leaving one open area, the first and second shielded connectors being mateable with one another such that open areas defined by the respective cover portions face in opposite respective directions.

5. The assembly of claim 4, wherein the exposed portion of the outer conductor is folded back over portions of the sheath adjacent thereto, the crimping portion of the outer terminal being crimped into engagement with the folded portion of the outer conductor.

* * * * *